United States Patent [19]

Yeakley

[11] 3,998,308

[45] Dec. 21, 1976

[54] COIN-OPERATED TOWEL DISPENSER

[75] Inventor: Glen E. Yeakley, Westfield, N.J.

[73] Assignee: Lawrence Peska Associates, Inc., New York, N.Y. ; a part interest

[22] Filed: Oct. 6, 1975

[21] Appl. No.: 620,192

[52] U.S. Cl. ..... 194/10; 225/10

[51] Int. Cl.[2] ..... G07F 11/24

[58] Field of Search ..... 225/10, 16; 226/200; 221/13, 71; 194/10, 2, DIG. 8

[56] References Cited

UNITED STATES PATENTS

| | | | |
|---|---|---|---|
| 3,074,607 | 1/1963 | Casey et al. | 194/10 X |
| 3,360,093 | 12/1965 | McDonald et al. | 194/10 |
| 3,730,409 | 5/1973 | Ratti | 225/10 |
| 3,838,761 | 10/1974 | Hakansson et al. | 194/2 |

*Primary Examiner*—Stanley H. Tollberg
*Attorney, Agent, or Firm*—Erwin S. Teltscher

[57] ABSTRACT

A towel dispenser for dispensing at least one towel from a towel roll containing a multiplicity of towels includes a towel cabinet having an outlet opening for dispensing one of the towels from the towel roll therethrough, rotative means disposed within the cabinet for effecting the withdrawal of one of the towels from the cabinet through the outlet opening, driving means for operatively engaging the rotating means, a prepayment mechanism for releasing the driving means by at least one coin supplied to the prepayment mechanism, a chute attached to the prepayment mechanism and a coin-collecting box attached to a wall separating the prepayment mechanism therefrom. The chute communicates with the prepayment mechanism and the coin-collecting box through the wall. The operation of the prepayment mechanism by the coin causes the towel dispenser to furnish one of the towels to a user upon activation of the driving means, the coin being collected in the coin-collecting box upon falling thereinto through the chute.

8 Claims, 6 Drawing Figures

FIG. 1
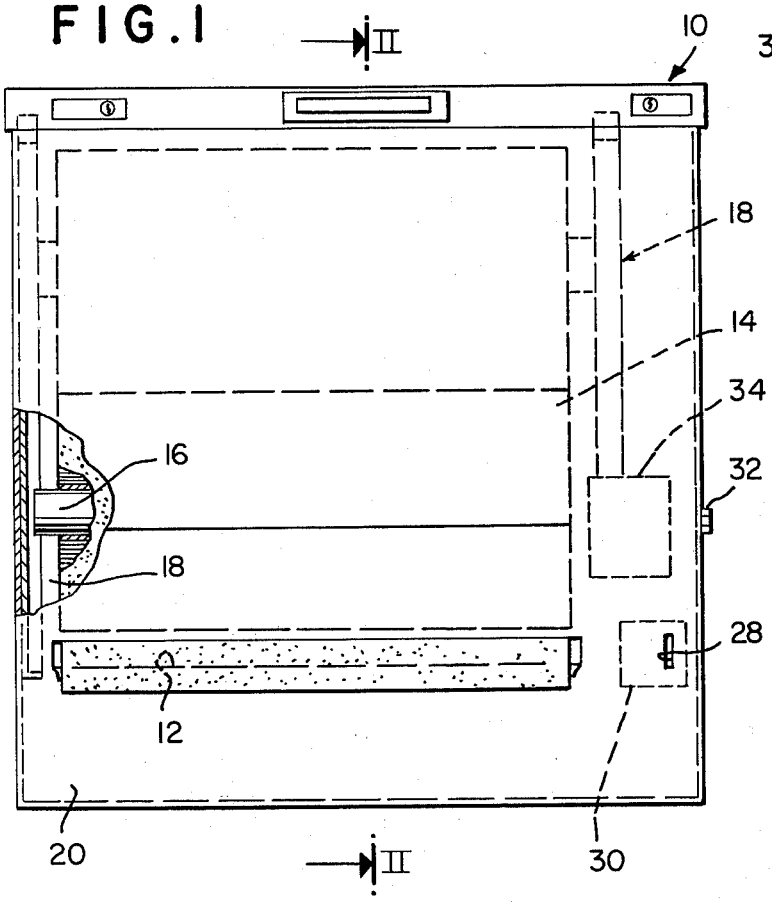
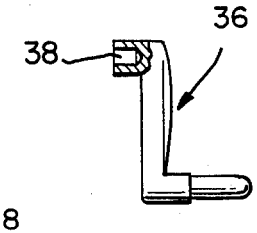
FIG. 3
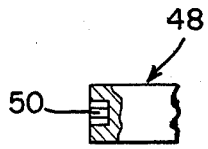
FIG. 5
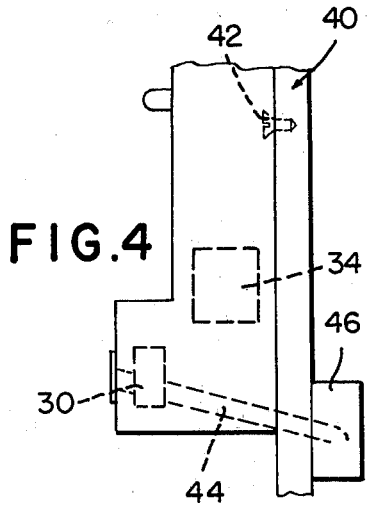
FIG. 4
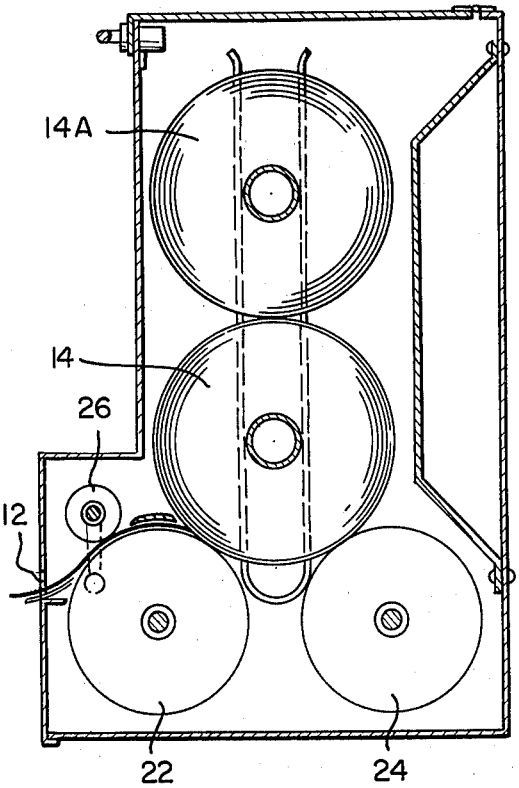
FIG. 2
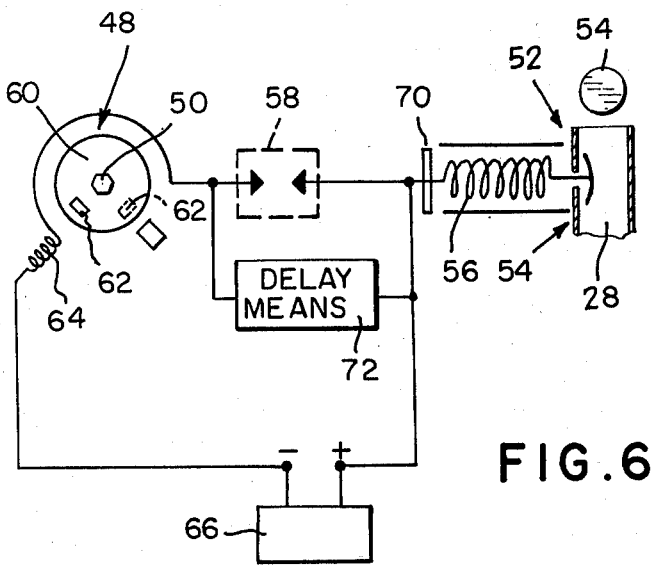
FIG. 6

COIN-OPERATED TOWEL DISPENSER

BACKGROUND OF THE INVENTION

The invention relates to a coin-operated towel dispenser.

Towels dispensers are known which provide towels upon activation of manual driving means. These towel dispensers are provided generally by the operators of various establishments, such as washrooms in garages, bathing establishments and the like as an accommodation or convenience, and so burden the operator of such establishment with a cost rather than providing a profit. Consequently relatively few establishments provide such towel dispensers, with a consequent loss to the public of a convenience, which many members of the public would prefer to other drying means, even if on a paid basis. The availability of a coin-operated towel dispenser thus acts as an incentive to an operator of the aforementioned establishments to provide such dispensers, since it provides a profit, rather than a cost. Means have therefore been sought to develop a relatively inexpensive coin-operated towel dispenser to fill the need outlined above.

SUMMARY OF THE INVENTION

I therefore provide a coin-operated towel dispenser which can be operated at a profit rather burdening the operator thereof with expenses and which is suitable for installations in washrooms and other public places. The towel dispenser, according to my invention, uses standard household paper towels, permits the collection of coins in placed relatively safe from burglars and vandals, and can be operated either manually or by an electric motor.

The towel dispenser according to my invention dispenses at least one towel from a towel roll containing a multiplicity of towels and includes a towel cabinet having an outlet opening for dispensing one of the towels from the towel roll therethrough, rotative means disposed within the cabinet for effecting a withdrawal of one of the towels from the cabinet through the outlet opening, driving means for operatively engaging the rotating means, a prepayment mechanism for releasing the driving means by at least one coin supplied to the prepayment mechanism, a chute attached to the prepayment mechanism and a coin-collecting box attached to a wall separating the prepayment mechanism therefrom. The chute communicates with the prepayment mechanism and the coin-collecting box through the wall. The operation of the prepayment mechanism by the coin causes the towel dispenser to furnish one of the towels to a user upon activation of the driving means, the coin being collected in the coin-collecting box upon falling thereinto through the chute.

It is advantageous if the towel dispenser also includes a manual operating mechanism or electric motor means attachable to the driving means for the activation thereof. The prepayment mechanism is preferably disposed within the cabinet, the cabinet being then formed with a slot for accepting a coin and further includes coin-operated means disposed therewithin for activating the electric motor means.

It is advantageous if the coin-operated means include spring means disposed within cabinet for being compressed upon the coin passing through the slot and normally open contact means for temporarily closing contacts thereon for activating the electric motor means; the contact means and the motor means being connected in series to opposite polarities of a power supply. It is then particularly advantageous if delay means are shunted across the contact means for extending the closure time there across.

In preferred embodiment of my invention the electric motor means includes a rotor rigidly attached to the driving means, the rotor having a permanent magnet attached thereto and an initial position, and at least one electromagnet disposed externally to the rotor and energizable by the contact means so that upon closure of the contact means the rotor is aligned with the electromagnet due to the attraction of the permanent magnet to the energized electromagnet so as to cause the electric motor to rotate by at least a fraction of a revolution, the rotor reverting to the initial position upon opening of the contact means.

It is finally advantageous if the towel roll used is perforated at periodic intervals so as to separate one of the multiplicity of towels from another and if the towel dispenser includes ratchet means for furnishing only one of the towels at a time a user upon operation of the prepayment mechanism.

BRIEF DESCRIPTION OF THE DRAWING

My invention will be better understood with reference to the accompanying drawings in which:

FIG. 1 is an elevational view of the coin-operated towel-dispenser according to my invention;

FIG. 2 is a section along line II—II of FIG. 1;

FIG. 3 is a sideview of the coin-operated towel-dispenser;

FIG. 4 is an elevational view of a manually operating mechanism attachable to the driving means;

FIG. 5 is a sideview of electric motor means attachable to the driving means; and FIG. 6 is a schematic diagram showing the interconnection between the motor means and part of the prepayment mechanism.

DESCRIPTION OF THE PREFERRED EMBODIMENT

FIG. 1 shows an elevational view of a towel dispenser 10 having an outlet opening 12 for dispensing towels from a towel roll 14, which contains a roll of standard household paper towels. The towel roll is disposed on a roller 16 held within two guide members 18 which are installed in a cabinet 20 of the towel dispenser 10. A second towel roll 14A is a disposed above the first towel roll 14, guide members 18 also holding the second towel roll 14A. Auxiliary guide rolls 22, 24 and 26 in operative frictional contact with the unwinding paper towels from the towel roll 14 assist to keep the unwinding paper in place. A slot 28 formed in the cabinet 20 serves to accept a coin, for example a penny, upon insertion of which a conventional prepayment mechanism 30 shown dotted in FIG. 1 and not further described in detail permits activation of a driving shaft 32. Operation of the latter in turn releasably engages the rotative means, comprising the roll 14 and auxiliary guide rolls 22, 24 and 26. A ratchet mechanism 34 shown dotted in FIG. 1 on 4 and not further described in detail, permits withdrawal of only one towel when the rotative means is actived by the driving shaft 32 upon insertion of a coin into the prepayment mechanism 30. Cooperation of the prepayment mechanism 30 with the ratchet mechanism 34 can be obtained, for example in a manner as taught by Hakansson et al in U.S. Pat. No. 3,838,761.

The driving shaft 32 is suitable for having a handle 36 attached thereto, as shown in FIG. 3. The driving shaft 32 can therefore have, for example, a hexagonal cross-section, and thus fit into a hexagonal recess 38 in the handle 36, the handle 36 in conjunction with the driving shaft 32 forming manual driving means for the paper towel dispenser 10.

In order to reduce the risk of burglary and vandalism, e.g. breaking into the towel dispenser 10 and its associated prepayment mechanism 30 with a view of collecting the coins deposited therein, I have made provision for physically separating the coin-collecting function of the towel dispenser 10 from its remaining functions.

In FIG. 4 the towel dispenser 10 is shown attached to, for example, a wall 40 by means of, for example, fastening means 42. A chute 44 leads from the prepayment mechanism 30 to a coin-collection box 46, so that upon activation of the prepayment mechanism by a coin, the towel dispenser is caused to furnish a towel to a user upon manual operation of the driving means; the coin is then collected in the coin-collection box 46 upon falling thereinto through the chute 44.

The driving shaft 32 can alternately be driven by an electric motor 48, formed with a hexagonal recess 50 for fitting onto the shaft 32. The electric motor 32 is then activated by coin-operated means 52 disposed within the cabinet 20 upon a coin 54 being inserted into the 28.

The coin-operated means 52 may consist, for example, of a compression spring 56, which is compressed, for example, when the coin 54 is pushed into the coin slot 28, and of normally open spring-operated contacts 58. The electric motor 48 may consist, for example, of a rotor 60, a permanent magnet 62 mounted on the rotor 60, and an electromagnet 64. A d.c. power supply 66 supplying a voltage is connected in series with the spring-operated contacts 58 and the electromagnet 64, a positive terminal of the d.c. power supply 66 being, for example, connected to the spring-actuated contact of contacts 58, as shown in FIG. 6, while power supply's negative terminal is connected, for example, to one terminal of the electromagnet 64, the latters other terminal being connected to the remaining contact of spring-operated contacts 58. A permanent magnet 68 normally aligns the rotor 60 of the motor 48 so that the permanent magnets 62 and 68 are aligned with each other, as shown in the dotted position of the magnet 62 in FIG. 6.

When a coin 54 is inserted into the slot 28, it compresses the spring 56, which then closes the contacts 58, an electrical insulated layer 70 being interposed between the spring 56 and the contacts 58. The closing of the contacts 58 energizes the electromagnet 64, so that the rotor 60 of the motor 48 takes up a position where the permanent magnet 62 of the rotor 60 is aligned with the electromagnet 64. The motor 48 consequently actuates the driving shaft so as to rotate it by an angle to activate the driving means of the towel dispenser 10, so that a user obtains a towel therefrom. Upon further passage of the coin 54 past the slot 28 and into the chute 44 the contacts 58 open, the electromagnet 64 is no longer energized, and the rotor 60 assumes its initial position, i.e. the permanent magnet 62 comes into alignment with the permanent magnet 68.

It is advantageous if a delay means 72, such as a bimetallic delay device, an astable multivibrator with appropriate actuating and output terminals or the like, is shunted across contacts 58 to ensure that the motor 48 is held in an energized position for a sufficient length of time for a towel to be dispensed from the towel dispenser 10.

It will, of course, be convenient if the towel roll 14 is perforated at periodic intervals so as to separate one of the multiplicity of towels from another, so that the ratchet mechanism 30 will furnish only one of the towels at a time to a user upon operation of the prepayment mechanism.

What is claimed is:

1. A paper towel dispenser for dispensing at least one towel from a towel roll containing a multiplicity of towels, comprising:
   - a towel cabinet having an outlet opening for dispensing one of the towels from the towel roll therethrough;
   - rotative means disposed within said cabinet for effecting the withdrawal of one of the towels from said cabinet through said outlet opening;
   - driving means for operatively engaging said rotating means comprising electric motor means attachable to said driving means for the activation thereof including:
     - a rotor rigidly attached to said driving means, the rotor having a permanent magnet attached thereto and having an initial position;
     - at least one electromagnet disposed externally to said rotor and energizable by said contact means so that upon closure of said contact means said rotor is aligned with said electromagnet due to the attraction of said permanent magnet to the energized electromagnet so as to cause said rotor to rotate by at least a fraction of a revolution, said rotor reverting to said initial position upon opening of said contact means;
   - a prepayment mechanism for releasing said driving means by at least one coin supplied to said prepayment mechanism;
   - a chute attached to said prepayment mechanism; and
   - a coin-collecting box attached to a wall separating said prepayment mechanism therefrom, said chute communicating with said prepayment mechanism and said coin-collecting box through the wall whereby operation of said prepayment mechanism by the coin causes the towel dispenser to furnish one of the towels to a user upon activation of said driving means, the coin being collected in said coin-collecting box upon falling thereinto through said chute.

2. A paper towel dispenser according to claim 1 further including a manual operating mechanism attachable to said driving means for the activation thereof.

3. A paper towel dispenser according to claim 1 wherein said prepayment mechanism is disposed within said cabinet, said cabinet being formed with a slot for accepting the coin, and further including coin-operated means disposed there within for activating said electric motor means.

4. A paper towel dispenser according to claim 3 wherein said coin-operated means includes:
   - spring-means disposed within said cabinet for being compressed upon the coin passing through said slot; and
   - normally open contact means having at least two contacts, for temporarily closing said contacts thereon for activating said electric motor means, said contact means and said motor means being connectable in series to opposite polarities of a power supply.

5. A paper towel dispenser according to claim 4 further comprising delay means shunted across said contact means for extending the closure time of said contacts.

6. A paper towel dispenser according to claim 1 wherein the towel roll used therein is perforated at periodic intervals so as to separate one of the multiplicity of towels from another, further including ratchet mechanism-means for furnishing only one of the towels at a time to a user upon operation of said prepayment mechanism.

7. A paper towel dispenser including first and spare towel rolls for dispensing at least one towel from one of said towel rolls, each of said towel rolls containing a multiplicity of towels, comprising:

a towel cabinet having an outlet opening for dispensing one of the towels from one of said towel rolls therethrough, said first towel roll being replaceable by said spare roll on being used up;

rotative means disposed within said cabinet for effecting the withdrawal of one of the towels from said cabinet through said outlet opening;

driving means for operatively engaging said rotating means;

a prepayment mechanism for releasing said driving means by at least one coin supplied to said prepayment mechanism;

a chute attached to said prepayment mechanism; and a coin-collecting box attached to a wall separating said prepayment mechanism therefrom, said chute communicating with said prepayment mechanism and said coin-collecting box through the wall whereby operation of said prepayment mechanism by the coin causes the towel dispenser to furnish one of the towels to a user upon activation of said driving means, the coin being collected in said coin-collecting box upon falling thereinto through said chute.

8. A paper towel dispenser for dispensing at least one towel from a towel roll containing a multiplicity of towels, comprising:

a towel cabinet having opening for dispensing one of the towels from the towel roll therethrough;

rotative means disposed within said cabinet for effecting the withdrawal of one of the towels from said cabinet through said outlet opening;

driving means for operatively engaging said rotating means;

a prepayment mechanism for releasing said driving means by at least one coin supplied to said prepayment mechanism;

a chute attached to said prepayment mechanism; and a coin-collecting box disposed remotely from said towel cabinet and attached to a wall separating said prepayment mechanism therefrom, said chute communicating with said prepayment mechanism and said coin-collecting box through the wall whereby operation of said prepayment mechanism by the coin causes the towel dispenser to furnish one of the towels to a user upon activation of said driving means, the coin being collected in said coin-collecting box upon falling thereinto through said chute.

* * * * *